US011358682B2

(12) United States Patent
Gonzales et al.

(10) Patent No.: US 11,358,682 B2
(45) Date of Patent: Jun. 14, 2022

(54) MOORING DEVICE

(71) Applicant: The HookCups Group, LLC, Calabasas, CA (US)

(72) Inventors: Steven Brant Gonzales, Santa Paula, CA (US); J. Scott Roberts, Leduc County (CA)

(73) Assignee: The HookCups Group, Inc., Humble, TX (US)

( * ) Notice: Subject to any disclaimer, the term of this patent is extended or adjusted under 35 U.S.C. 154(b) by 0 days.

(21) Appl. No.: 17/513,828

(22) Filed: Oct. 28, 2021

(65) Prior Publication Data

US 2022/0048598 A1 Feb. 17, 2022

Related U.S. Application Data

(63) Continuation of application No. 17/219,853, filed on Mar. 31, 2021.

(60) Provisional application No. 63/018,368, filed on Apr. 30, 2020.

(51) Int. Cl.
*B63B 21/00* (2006.01)

(52) U.S. Cl.
CPC ..... *B63B 21/00* (2013.01); *B63B 2021/001* (2013.01); *B63B 2021/006* (2013.01)

(58) Field of Classification Search
CPC ..... B63B 21/00; B63B 2021/001; B63B 2021/006
See application file for complete search history.

(56) References Cited

U.S. PATENT DOCUMENTS 5,676,085 A * 10/1997 Michl, Jr. ..... B63B 21/00 114/230.17
7,229,059 B1 * 6/2007 Hood ..... F16M 13/022 248/205.8
7,293,519 B2 * 11/2007 Montgomery ..... E02B 3/20 114/230.1
9,027,496 B2 * 5/2015 Zucco ..... E02B 3/20 114/230.15
9,199,696 B1 * 12/2015 Bonell ..... B63B 21/00
2009/0230686 A1 * 9/2009 Catlin ..... F03B 13/264 290/54
2016/0340948 A1 * 11/2016 McCullough ..... E05C 19/00
2021/0371051 A1 * 12/2021 Givens ..... B63B 21/00

OTHER PUBLICATIONS

4 Head Suction Cup Windshield Holder—https://www.autobodytoolmart.com//4-head-suction-cup-windshield-holderdentpuller-p-16990.aspx?gclid=EAIaIQobChMlvYy2ndOz6AIVUIFaBR0ZVA-6EAQYCCABEgLSwPD_BwE.
Prostock Suction Cup Cleat—https://www.boatownerswarehouse.com/product_p/121358.htm.
MagicMoor—https://www.myboatlife.com/2018/07/new-marine-accessory-for-easier-boat-raft-upor-mooring.html.

* cited by examiner

*Primary Examiner* — S. Joseph Morano
*Assistant Examiner* — Jovon E Hayes
(74) *Attorney, Agent, or Firm* — Rao DeBoer Osterrieder, PLLC; John M. DeBoer

(57) ABSTRACT

A mooring device including: a strut with a first end and a second end; a first head; a pivot mount; a first suction cup; a rotating mount; a second head; a second suction cup; a rod; and a flotation cover sleeve. The pivot mount allows the first head to pivot about a first head axis and therefore to rotate relative to the strut. The rotating mount allows the suction cup to rotate about a second axis relative to the strut. The flotation cover sleeve having a buoyancy sufficient to render the entire apparatus positively buoyant in water.

18 Claims, 5 Drawing Sheets

MOORING DEVICE

CROSS-REFERENCE TO RELATED APPLICATIONS

This invention claims priority, under 35 U.S.C. § 120, to the U.S. Nonprovisional patent application Ser. No. 17/219,853, titled MOORING DEVICE, to Steven Brant Gonzales filed on Mar. 31, 2021, as well as claims priority, under 35 U.S.C. § 120, to the U.S. Provisional Patent Application No. 63/018,368 to Steven Brant Gonzales filed on Apr. 30, 2020, as well as claims priority, under 35 U.S.C. § 120, to the U.S. Design patent application Ser. No. 29/737,259 to Steven Brant Gonzales filed on Jun. 8, 2020, all of which are incorporated by reference herein.

BACKGROUND OF THE INVENTION

Field of the Invention

The present invention relates to tethering and mooring devices, specifically to boat tethering and mooring devices.

Description of the Related Art

In the related art, it has been known to use tethering devices to moor or dock various types of boats to fixed structures such as docks or buoys, as well as to attach boats to one another. These tethering devices are sometimes difficult to install and/or sometimes fail to securely hold their associated boat securely to the fixed structure or other boat. Some improvements have been made in the field. Examples of references related to the present invention are described below in their own words, and the supporting teachings of each reference are incorporated by reference herein:

U.S. Pat. No. 5,676,085, issued to Michl, Jr., discloses a vacuum operated mooring device consisting of a telescopic and lockable connecting arm, to connect and hold apart at a distance, one boat from another or a boat from a dock. At both extremities of the connecting arm are single and multiple axes connected to manually operated vacuum devices that produce a continuous supply of vacuum, within limits, and supply the vacuum to rubber suction cups attached to the boats. By means of the multiple axes extremities of the mooring device, these suction cups can be connected to a multitude of connecting points, either on the side of the hull or on top of the deck of the boat. By the unique use of the vacuum device and rubber suction cups there is no need to have permanent brackets installed on any boat that this device is to be used upon, thus the vacuum device and vacuum cups of this invention allow for quick and easy installation and removal.

U.S. Patent Application Publication No.: 2016/0340948, by McCullough, discloses a child restraint device for preventing children from opening sliding doors or sliding windows, the device having a suction cup on each end of a handle, the suction cups being adapted to be attached to sliding door or sliding window panes that are disposed in different planes.

A suction cup windshield holder (found at: https://www.autobodytoolmart.com//4-head-suction-cup-windshield-holderdentpuller-p-16990.aspx?gclid=EAIaIQobChMIvYy2ndOz6AIUIFaBR0ZVA-6EAQYCCABEgLSwPD_BwE), discloses a device for picking up windshields, the device having multiple suction cups connected to one another.

A suction cup cleat (found at: https://www.boatownerswarehouse.com/product_p/121358.htm), discloses a device for attaching to a boat to tie a line off to, the device having suction cups connected to one another.

MagicMoor (found at: https://www.myboatlife.com/2018/07/new-marine-accessory-for-easier-boat-raft-upor-mooring.html), discloses a device for connecting boats to fixed structures or to one another, the device having attachment points of which connect to the cleats on the boat(s) and/or structure.

The inventions heretofore known suffer from a number of disadvantages which include: weak holding power, requiring tools to assemble/utilize/install, not being able to float in the water, more likely to disengage, allowing boat to come into contact with the attached structure or other boat, not allowing for rotation along two-axis to allow for independent boat movement, not durable, prone to breakage during high-wave circumstances, and causing cosmetic damage to the boat.

What is needed is a tethering device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available docking and mooring devices. Accordingly, the present invention has been developed to provide a satisfactory docking and mooring device There may be an apparatus for mooring a boat to another boat or support structure, which may include one or more of the following: a strut having a first end and a second end, a first head that may be pivotally coupled to the first end of the strut which may be by a pivot mount, and/or may pivot about a first head axis that may be at an angle relative to the strut, a first suction cup that may be rotatably coupled to the first head which may be by a rotating mount that may rotate about a first cup axis that may be at an angle relative to the strut and/or the first head axis, a second head that may be coupled to the second end of the strut, a second suction cup that may be rotatably coupled to the second head which may be by a rotating mount and/or may rotate about a second cup axis that may be at an angle relative to the strut, the second head may be fixedly coupled to the second end, a third suction cup that may be coupled to the first head and may be opposite the first suction cup and may be able to rotate relative to the first head, the first head and the second head may each be elongated members which may be extending substantially orthogonal to the strut, the first head may further include a rod which may be extending through an aperture through the first head, the rod may be rotatable within the aperture and/or may be fixedly coupled to the first suction cup, the second head may further include a rod which may be extending through an aperture through the second head, the rod may be rotatable within the aperture and/or may be fixedly coupled to the second suction cup, the strut may be a hollow tube which may have a mount socketed thereto at the first end, the mount may include a first head axis pin which may be functionally coupled to the first head, the second head may be T-shaped, the first head may have paired tabs which may extend outwardly therefrom and/or may pivotally coupled to the strut, and a flotation cover sleeve which may be coupled about the strut, the flotation cover sleeve may have a buoyancy sufficient to render the entire apparatus positively buoyant in water.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
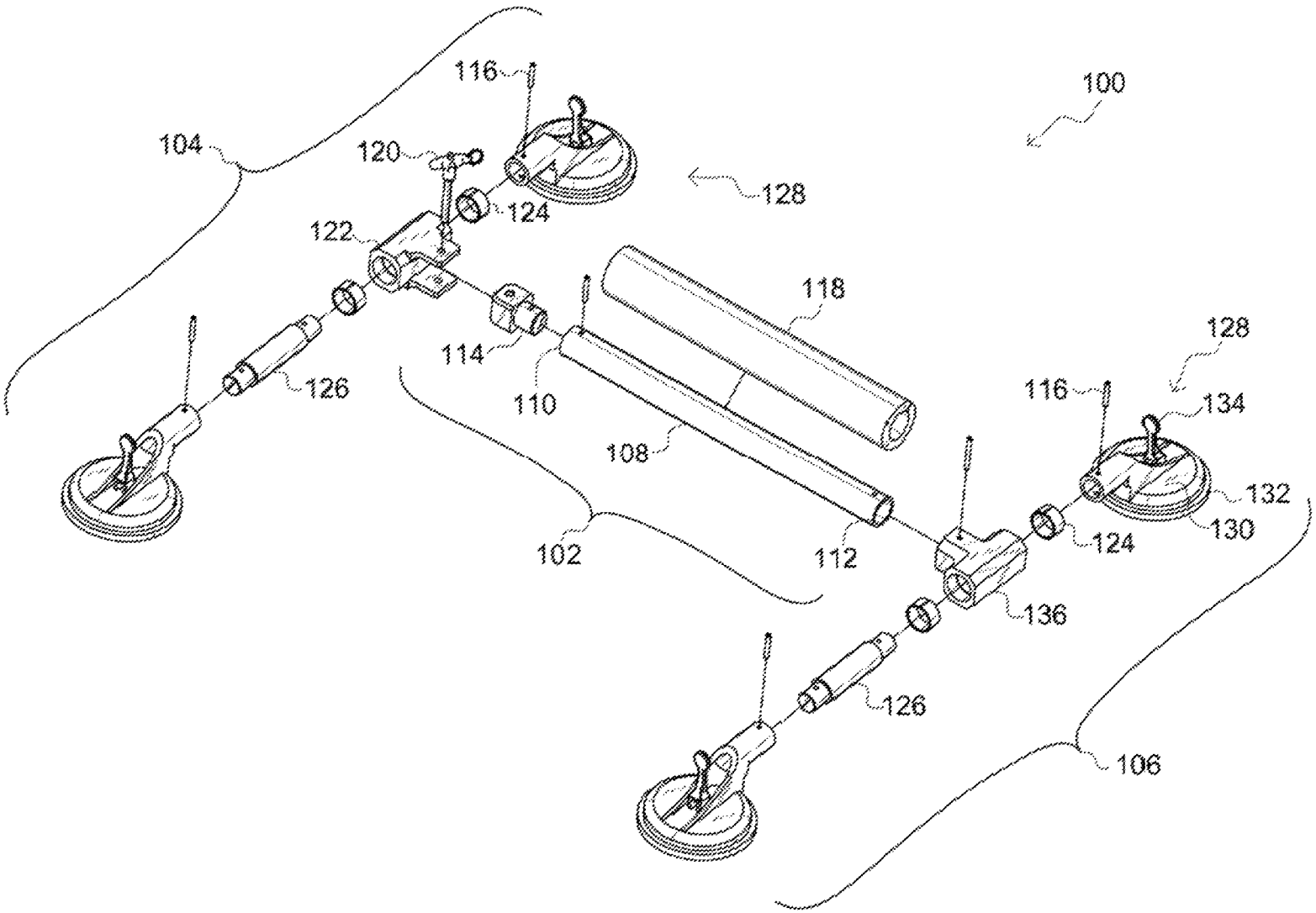
FIG. 1 is an exploded view of a suction cup mooring device, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is an exploded view of a suction cup mooring device, according to one embodiment of the invention. There is shown a mooring device 100 including a strut 102 pivotally coupled on a first end 110 to a first head 104 and rigidly coupled on a second end 112 to a second head 106.

The illustrated strut 102 includes a hollow tube 108 rigidly coupled on a first end 110 to a mount 114. As illustrated, the strut 102 and the mount 114 have one or more holes, upon which being lined up, dowels 116 can be pressed into to secure them to each other. In other embodiments, there may be more than one strut 102 or hollow tube 108, the hollow tube 108 or strut 102 may be selectably extendable though telescoping or having a hinge, ball joint, or other rotating or pivoting connection, and/or the hollow tube 108 may be a solid piece, a tube filled with a buoyant material, and the like and combinations thereof.

The illustrated hollow tube 108 is enclosed within a flotation sleeve 118, which includes an integrated cover sleeve for protection and aesthetics, however in other embodiments, the cover sleeve may be separated from the flotation sleeve 118. The flotation sleeve 118 and/or the cover sleeve may be slit down one or more sides to enable easy install, replacement, and upgrade. The flotation sleeve 118 and the cover sleeve may be fitted with hook and loop fasteners, straps, buttons, clips, and the like and combinations thereof in order to securely remain in place once installed over or around the flotation sleeve 118 and the hollow tube 108.

The flotation sleeve 118 may also be another buoyant object, such as a buoy or one or more flotation rings encircling or otherwise connected to the strut 102. The volume of the flotation sleeve 118 is selected to counter any negative buoyancy of the mooring device 100 and to result in a net positive buoyancy for the entire device. This volume may be determined by progressively attaching larger sleeves until positive buoyancy is achieved or may be determined by weighing the mooring device 100 while submerged in water to determine total negative buoyancy and then selecting a sleeve size that has greater positive buoyancy than the determined negative buoyancy.

The illustrated first head 104 includes a detent pin 120 and a tabbed pipe 122, which has a hole sized similarly to one in the mount 114 through which the detent pin 120 may be inserted, rotatably coupling the first head 104 to the strut 102. The tabbed pipe 122 also has bushings 124 inserted into each opposing end. A rod 126 is inserted through the bushings 124 and tabbed pipe 122, may rotate therein, and has an end on each side protruding from the tabbed pipe 122. The rod 126 may be selectably extendable, such as being telescopic, so as to allow the user additional flexibility with mounting locations.

Suction cups 128 are rigidly coupled to the protruding ends of the rod 126 and may rotate in conjunction with the rod 126. The suction cups 128 and rod 126 have one or more holes, upon which being lined up, dowels 116 can be pressed into to secure them to each other.

The illustrated suction cups 128 include a base 130, a pad 132, and a lever 134. The base 130 provides a stable mounting point for the pad 132 and the lever 134 as well as allows pressure to be evenly and accurately applied to the suction cups 128 to enable easy mounting. The base 130 also has a through hole where it mounts to the pad 132 and to the lever 134.

The illustrated pad 132 is mounted to one side of the base 130 and is concave in shape in order to create a pressurized sealed area when pressed against a boat hull, however, may also be flat in shape. The pad 132 is made of a flexible material in order to create a good seal when pressed against a boat hull as well as account for any imperfections or surface differences on the boat hull. Such materials may include, but are not limited to rubber, silicone, soft plastics, and the like and combinations thereof. The pad 132 may also be coated with substances to assist in creating a seal or to protect the pad 132 from the elements, such as oils, petroleum jellies, UV protectants, and the like and combinations thereof. The pad 132 may have a through hole where it mounts to the base 130.

The illustrated lever 134 is mounted to the side of the base 130 opposite the pad 132, however in other embodiments may be mounted elsewhere on the base 130. The lever 134 may be configured to pull up on the suction cups 128 to create a pressure differential and/or open and close the hole in the base 130 and the pad 132, thereby allowing the suction cups 128 to maintain a negative pressure differential compared to the outside pressure, enabling it to cling to the boat hull or other mounted surface. The lever 134 may also be spring loaded or otherwise biased open or shut to assist the user in using the lever 134 or to prevent the lever 134 from continuously moving back and forth when not in use.

The illustrated second head 106 includes a tee 136, which has a hole through which a dowel may be inserted, coupling the second head 106 to the strut 102. The tee 136 also has bushings 124 inserted into each opposing end. A rod 126 is inserted through the bushings 124 and the tee 136, may rotate therein, and has an end on each side protruding from the tee 136. Suction cups 128 are rigidly coupled to the protruding ends of the rod 126 and may rotate in conjunction with the rod 126.

Although the illustrated embodiment is shown with four suction cups, various numbers of suction cups may be used depending on the desired use, such as singular suction cups, arrays of suction cups, and the suction cups may be arranged so as to add or reduce the rigidity of the mounting, such as triangular arrangements to promote strength in all directions, or linearly to allow the suction cups to break free if there is too much stress in one direction.

In other embodiments, one or more of the dowel-in-hole connections of the mooring device 100 may be configured to receive other fastening mechanisms such as pins, rivets, ball detents, screws, set screws, and the like and combinations thereof. Other embodiments may instead have one or more of the connections create via threading together, adhesives, epoxies, press fitting, latching, and the like and combinations thereof.

The structural pieces of the mooring device 100 may be made of any material with a high strength-to-weight ratio, such as metals, hard plastics, wood, and the like and combinations thereof. These materials may be plated, coated, or painted to assist in preventing exposure damage such as corrosion or UV damage. With respect to flotation sleeve 118, it may be made of any material that provides buoyancy, such as foams, woods or plastics, and the like and combinations thereof. The cover sleeve may be made of fabric or flexible plastic and the like and combinations thereof. The flotation sleeve 118 and cover sleeve may also be coated or impregnated with a chemical solution, oil, or metal to help them be UV, mildew, and/or water resistant.

In operation, the suction cups 128 of the first head 104 are pressed onto the hull of a first boat. Once the suction cups 128 are pressed against the hull, the user presses down the lever 134 on each of the suction cups 128 of the first head 104, which each act as a mechanical vacuum actuator, and rigidly secures suction cups 128 to the hull of the first boat. Thereafter, the user rotates the second head 106 to line up the suction cups 128 of the second head 106 with a second boat. The user then presses the suction cups 128 of the second head 106 against the second boat and then presses down the lever 134 on each of the suction cups 128 of the second head 106, which each act as a mechanical vacuum actuator, and rigidly secures suction cups 128 to the hull of the second boat. It may also be that installation of second end 112 may be done prior to or concurrently with installation of first end 110.

Another method to install the mooring device 100 is to pull the pin which connects the tabbed pipe 122 of the first end 110 to the mount 114 of the strut 102. This separates the first head 104 from the strut 102 and second head 106. The suction cups 128 of the first head 104 are then secured to a first boat by engaging the lever 134 of the first end 110, while the suction cups 128 of the second end 112 are secured to a second boat by engaging the lever 134 of the second end 112. Once the suctions cups of the first end 110 and the second end 112 are secured to the respective boats, the mount 114 is inserted between the flanges of the tabbed pipe 122 and the detent pin 120 is inserted through the tabbed pipe 122 and the mount 114, thereby securing the first head 104 to the strut 102 and second head 106.

Advantageously, the mooring device 100 is a durable and ready-to-use device that is able to rigidly couple two boats to one another, while also maintaining a high level of flexibility. This allows mooring device 100 to have a large amount of holding power while also being able to compensate for movement of the boats without allowing them to make direct contact with one another. The device thereby both keeps the boats separate while also being significantly less likely to disengage from and free the boats or otherwise cause cosmetic damage to the boats.

Figure 2:
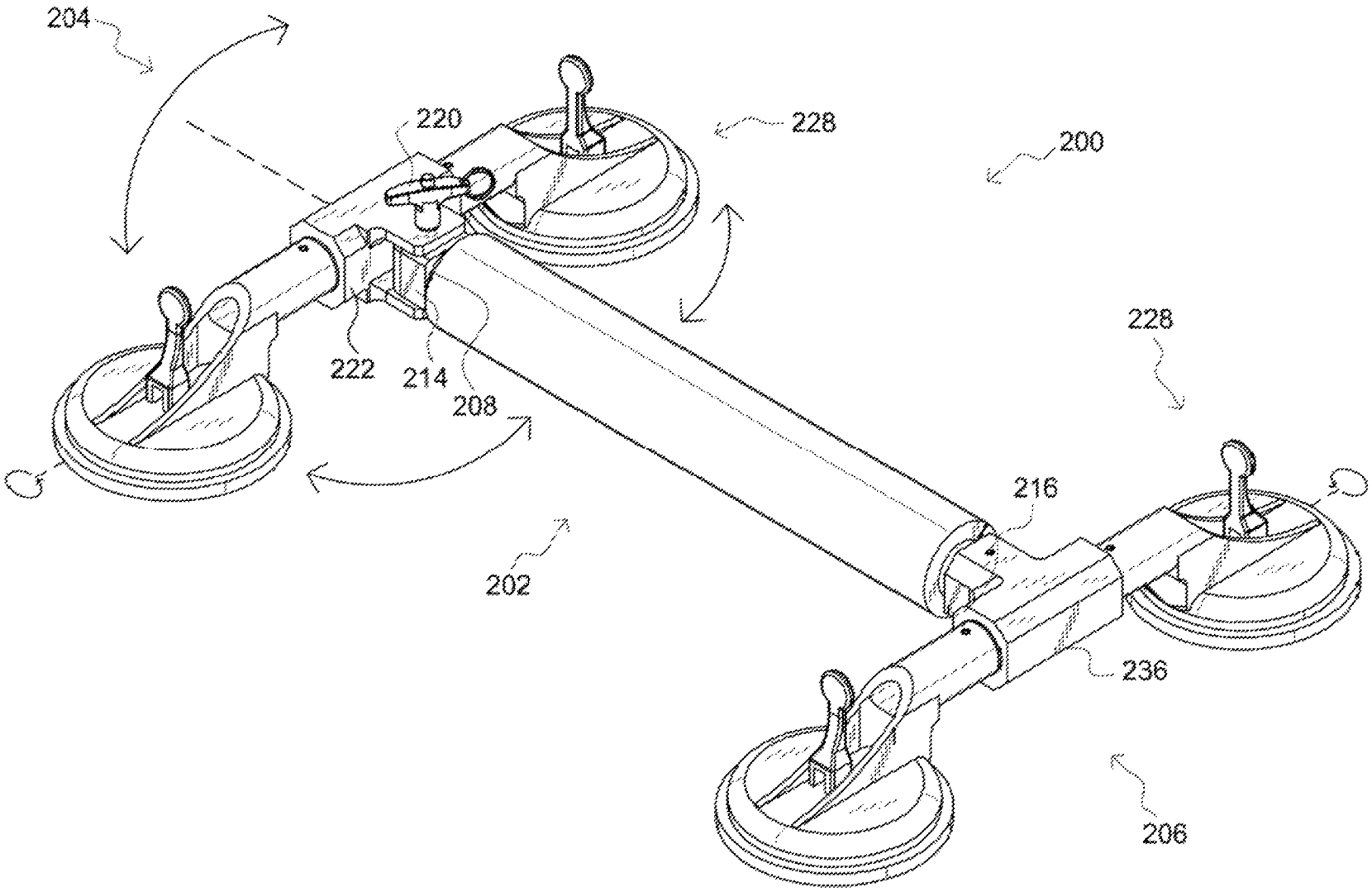
FIG. 2 is a top perspective view of an assembled suction cup mooring device, according to one embodiment of the invention.

FIG. 2 is a top perspective view of an assembled suction cup mooring device, according to one embodiment of the invention. The illustrated mooring device 200 is shown with the suction cups 228 able to freely rotate relative to the tabbed pipe 222, the suction cups 228 mounted one on each side close to the tabbed pipe 222 to prevent the tabbed pipe 222 from sliding back and forth between the suction cups 228.

As shown, the mount 214 is inserted into the tabbed pipe 222, with the detent pin 220 inserted through each, thereby attaching the first head 204 to the strut 202. This allows the first head 204 to pivot relative to the strut 202, and when combined with the rotation of the suction cups 228, gives the first head 204 two axes of motion relative to the rest of the mooring device 200.

The illustrated embodiment shows the hollow tube 208 inserted into the tee 236, with a dowel pin 216 inserted, thereby rigidly attaching the second head 206 to the strut 202. This creates a rigid connecting structure that does not allow the second head 206 to pivot relative to the strut 202, preventing the mooring device 200 from collapsing in on itself, however still allows two connected boats to pivot, move forwards or backwards relative to one another, or rise and fall relative to one another without putting excessive stress on the parts of the mooring device 200.

Figure 3:
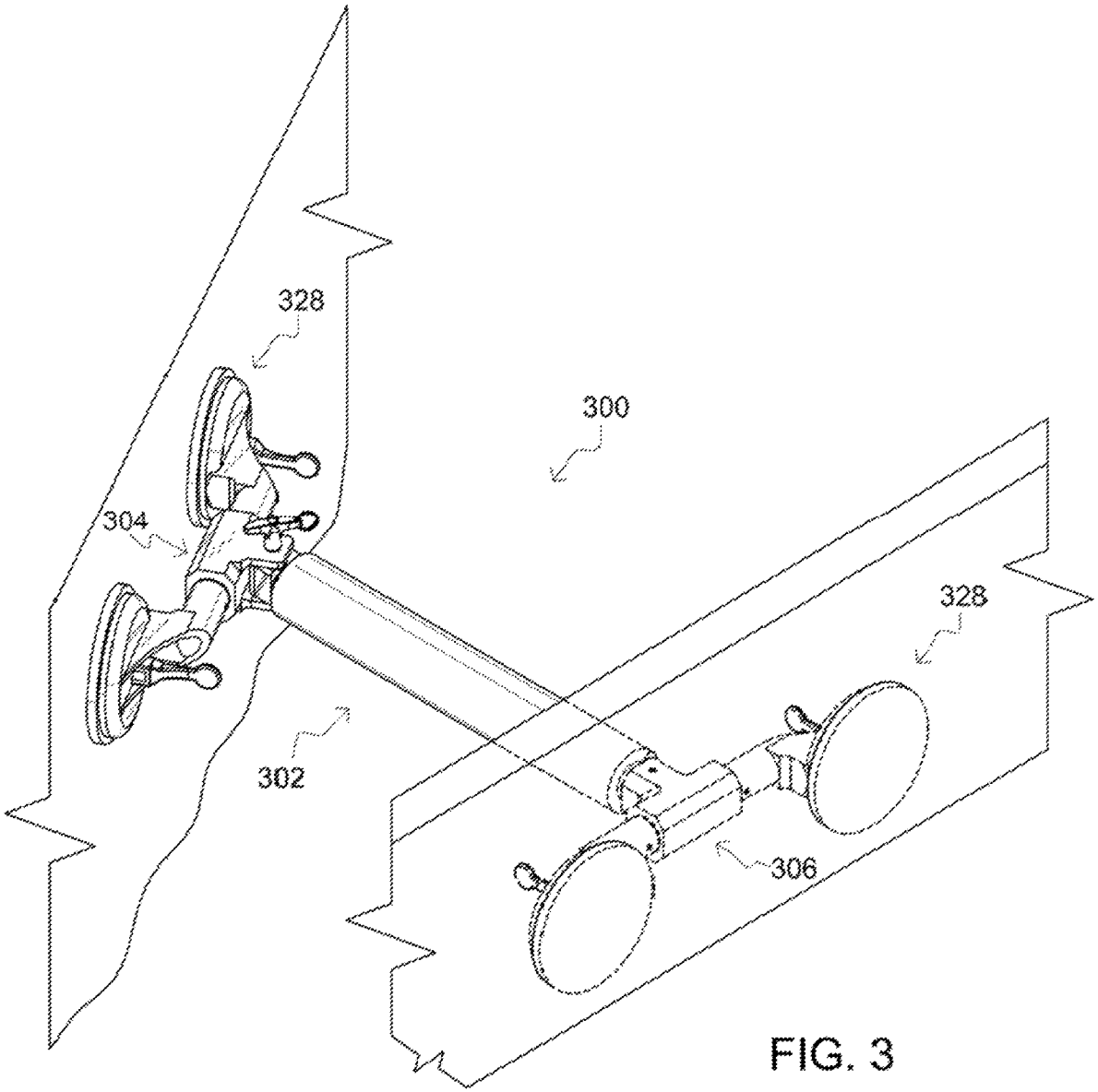
FIG. 3 illustrates an assembled suction cup mooring device in an installed position, according to one embodiment of the invention.

FIG. 3 illustrates an assembled suction cup mooring device in an installed position, according to one embodiment of the invention. The illustrated mooring device 300 is shown with the suction cups 328 rotated and rigidly attached to two separate surfaces, and the first head 304 pivoted to accommodate the angle between the suction cups 328 of the first head 304 attached to the first surface and the suction cups 328 of the second head 306 attached to the second surface.

As illustrated, the first head 304 is pivoted relative to the strut 302, as well as the suction cups 328 are rotated relative to the first head 304. The two axes of motion of the first head 304 allow the mooring device 300 to compensate for movement of the surfaces in the x-axis and y-axis, as well as allows the boats to pivot around the x-axis and y-axis. In embodiments where the connections on the heads 304, 306 or strut 302 are rotatable, movement in the z-axis could also be achieved. The rigidity of the second head 306 connection to the strut 302 allows the movement between the surfaces without allowing the mooring device 300 to collapse in on itself and thus allowing the surfaces to make direct contact with one another and cause damage.

Figure 4:
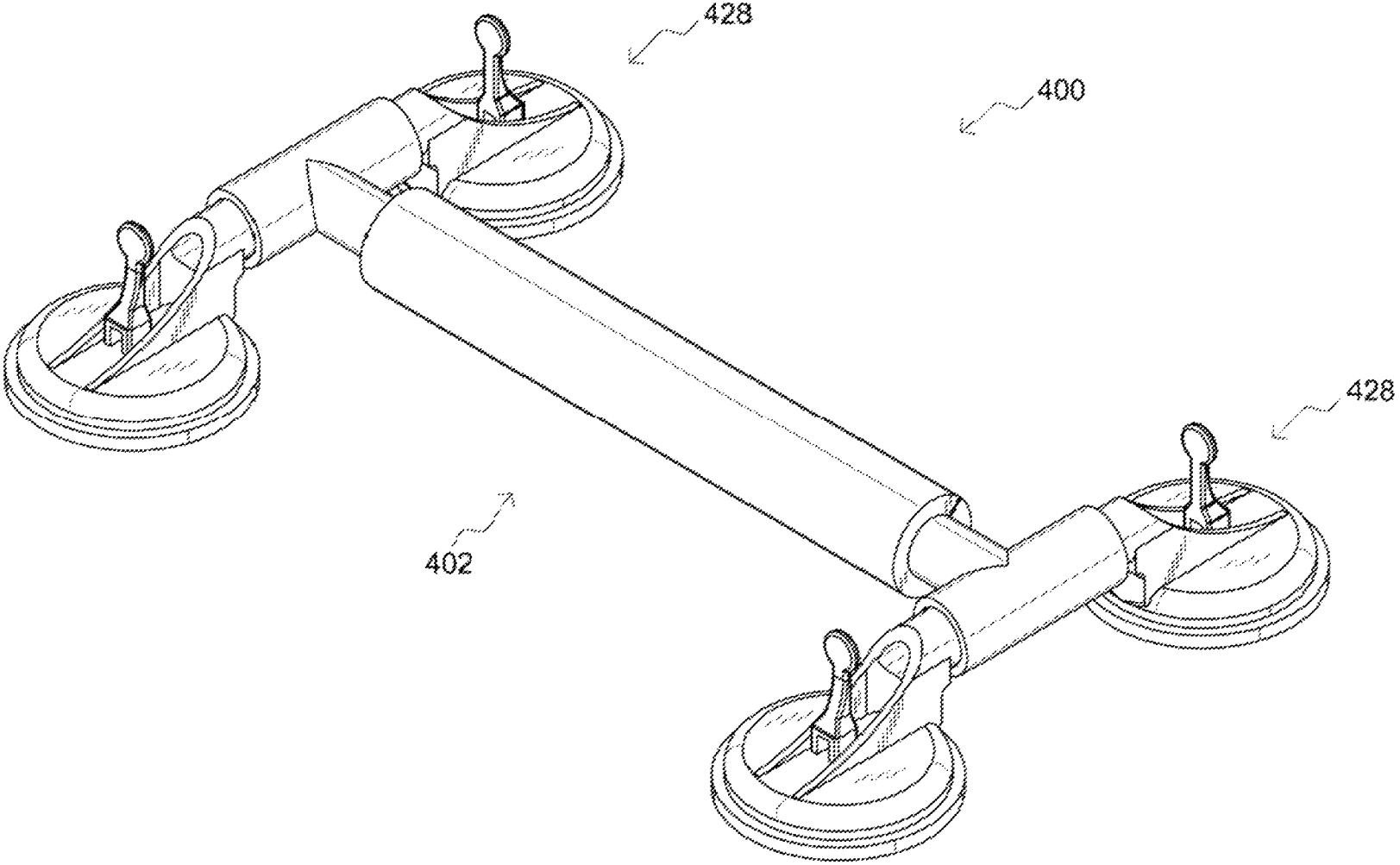
FIG. 4 is a top perspective view of an assembled suction cup mooring device, according to one embodiment of the invention.

FIG. 4 is a top perspective view of an assembled suction cup mooring device, according to one embodiment of the invention. The illustrated mooring device 400 is shown with a strut 402 that extends all the way to the suction cups 428, which are able to freely rotate relative to the strut 402, the suction cups 428 mounted one each side close to the strut 402 to prevent the strut 402 from sliding back and forth between the suction cups 428.

The illustrated mooring device 400 allows the connected boats to rise and fall with one another without being able to move forwards or backwards relative to one another or pivot towards or away from one another, preventing contact between them. This also promotes rigidity and strength in the system, as pin or other connections are replace by solid structure and thus allows the user to keep two boats spaced a constant distance from one another.

Figure 5:
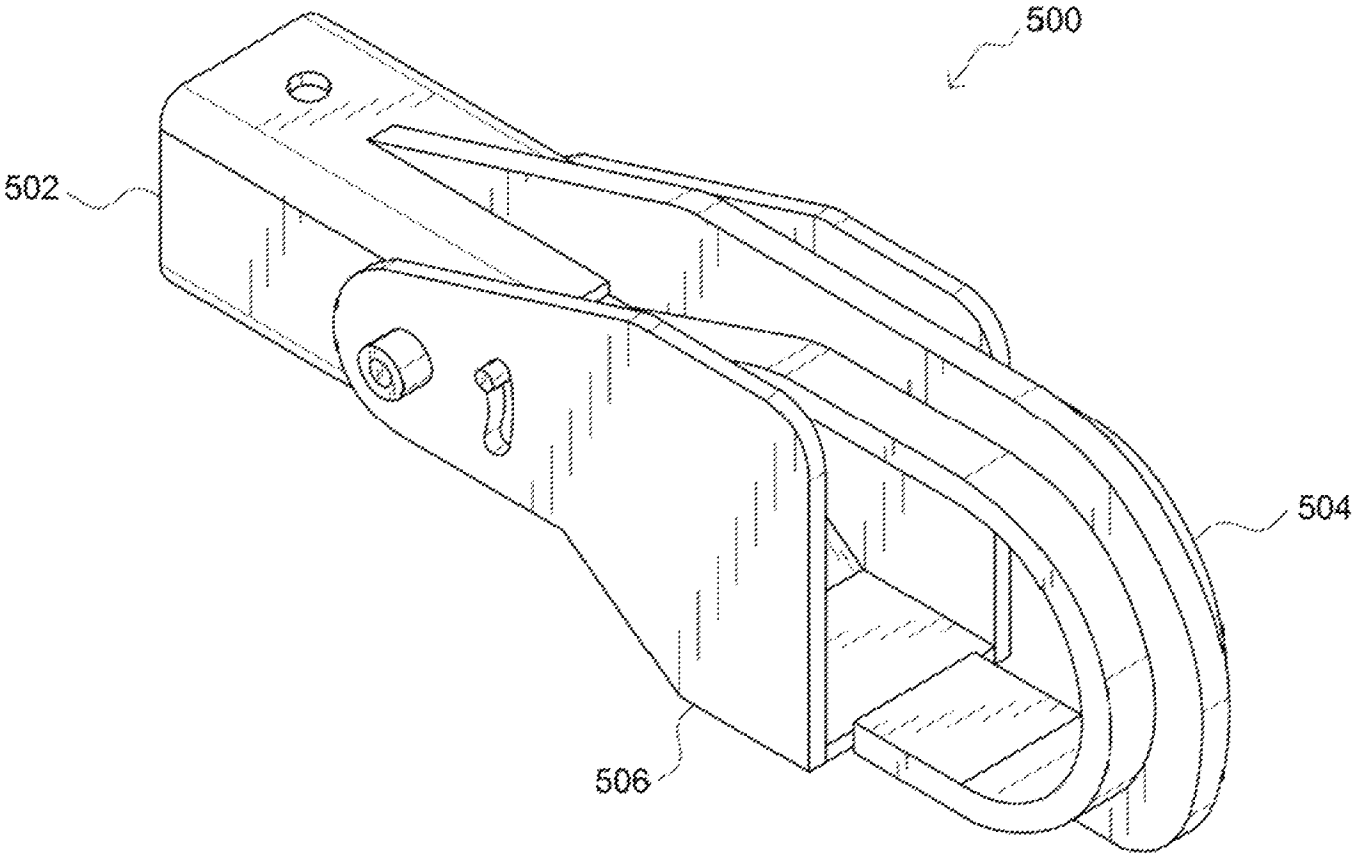
FIG. 5 illustrates a connector of a suction cup mooring device, according to one embodiment of the invention.

FIG. 5 illustrates a connector of a suction cup mooring device, according to one embodiment of the invention. The illustrated connector 500 includes a mounting end 502, a hook 504, and a safety latch 506. In operational context, such as but not limited to in use with the structure shown in FIG. 1, the mounting end 502 on one side may be pivotally connected to the mount 114 of the first end 110 of the strut 102 through a pin connection. The connector 500 may also rigidly couple to the second end of the strut by pressing a dowel through the hole in the second end 112 and the mounting end 502. The mounting end 502 may have a different shape, such as round, oblong, polygonal, and the like in order to securely couple to different shaped mounts 114, first ends 110, or second ends 112.

The illustrated hook 504 is rigidly connected to the mounting end 502 through a weld, however, may also be connected by any number of mechanical fasteners such as bolts, rivets, screws, press fit, and the like and combinations thereof. The hook 504 may also be formed with the mounting end as one piece to negate the need for fastening the pieces together. The hook 504 may have a spine to increase the strength of the hook without drastically increasing the weight.

The illustrated safety latch 506 is pivotally connected to the mounting end 502 through a bolt. The safety latch may pivot relative to the mounting end to open and close access to the hook 504. The safety latch 506 may include a spring or torsion spring to bias the safety latch 506 open or closed and may also include a pin or latch to hold the safety latch 506 open or lock it shut.

To use the illustrated connector 500, the user presses the bottom of the safety latch 506 on an object, such as a cleat, hook, ring, or the like, which biases the safety latch towards the open position and moves the object past interference with the hook 502. Once the object is clear of the hook 502, the user pushes the object forward or the connector 500 backwards until the object is clear of the front of the safety latch 506. Without the user biasing the safety latch 506 open, the torsion spring in the safety latch 506 then biases the safety latch 506 shut, which locks the object within the connector 500.

To remove, the user biases the safety latch 506 open and then pushes the object backwards or the connector 500 forwards until the object is clear of the tip of the hook 502. The user then pushes the object down or the connector 500 up until the object is clear of the bottom of the hook 502.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the parts are designed to be resistant to conditions seen on or near the water, such as salt, water, wind, and sun, other embodiments may be useful on land or in enclosed structures, wherein connecting structures such as bearings and ball joints may be in place of pin connections and bushings or rods to provide additional movement without the risk of premature degradation.

Additionally, although the figures illustrate suction cups to attach relatively smooth and uniform surfaces to one another, the suction cups or the first or second head may be replaced by rings, hooks, clamps, pins, brackets, clasps, or other fasteners known to a person skilled in the art so that the mooring device may be affixed to cleats, rails, towers, hooks, loops, or other desired structures.

It is also envisioned that the central support need not be a rigid material, so that the mooring device may be used for towing a boat or other object without the directional movement limitations that rigid structure brings.

It is expected that there could be numerous variations of the design of this invention. An example is that the suction cups are replaced by more permanent structure, such as a threaded connection, pin connection, or clamp which would drastically increase the holding power of the mooring devices as well as enable a user to permanently affix each connection end to commonly used boats or other structure so that the user reduces the number of parts needed to affix the two objects.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. An apparatus for mooring a boat to another boat or support structure, comprising:

a) a strut having a first end and a second end;

b) a first head pivotally coupled to the first end of the strut by a pivot mount, pivoting about a first head axis that is at an angle relative to the strut;

c) a first suction cup rotatably coupled to the first head by a rotating mount rotating about a first cup axis that is at an angle relative to both the strut and the first head axis;

d) a second head coupled to the second end of the strut; and e) a second suction cup rotatably coupled to the second head by a rotating mount rotating about a second cup axis that is at an angle relative to the strut.

2. The apparatus of claim 1, wherein a second attachment end of the second head is fixedly coupled to the second end.

3. The apparatus of claim 1, including a third suction cup coupled to the first head opposite the first suction cup and able to rotate relative to a first attachment end.

4. The apparatus of claim 1, wherein the first head and the second head are each elongated members extending substantially orthogonal to the strut.

5. The apparatus of claim 4, wherein the second head is T-shaped, and wherein the first head has paired tabs extending outwardly therefrom and pivotally coupled to the strut.

6. The apparatus of claim 1, wherein the second head is T-shaped, and wherein the first head has paired tabs extending outwardly therefrom and pivotally coupled to the strut.

7. The apparatus of claim 1, wherein the strut is a hollow tube having a mount socketed thereto at the first end, the mount including a first head axis pin and functionally coupled to the first head.

8. The apparatus of claim 1, wherein the second head is T-shaped.

9. The apparatus of claim 1, wherein the first head has paired tabs extending outwardly therefrom and pivotally coupled to the strut.

10. The apparatus of claim 1, further comprising a flotation sleeve coupled about the strut, the flotation sleeve having a buoyancy sufficient to render the entire apparatus positively buoyant in water.

11. An apparatus for mooring a boat to another boat or support structure, comprising:

a) a strut having a first end and a second end;

b) a first head pivotally coupled to the first end of the strut by a pivot mount, pivoting about a first head axis that is at an angle relative to the strut, wherein the first head is an elongated member;

c) a first suction cup rotatably coupled to the first head by a rotating mount rotating about a first cup axis that is at an angle relative to both the strut and the first head axis;

d) a second head coupled to the second end of the strut, wherein the second head is an elongated member; and e) a second suction cup rotatably coupled to the second head by a rotating mount rotating about a second cup axis that is at an angle relative to the strut.

12. The apparatus of claim 11, wherein a second attachment end of the second head is fixedly coupled to the second end.

13. The apparatus of claim 12, including a third suction cup coupled to the first head opposite the first suction cup and able to rotate relative to a first attachment end.

14. The apparatus of claim 13, wherein the strut is a hollow tube having a mount socketed thereto at the first end, the mount including a first head axis pin and functionally coupled to the first head.

15. The apparatus of claim 14, wherein the second head is T-shaped.

16. The apparatus of claim 15, wherein the first head has paired tabs extending outwardly therefrom and pivotally coupled to the strut.

17. The apparatus of claim 16, further comprising a flotation sleeve coupled about the strut, the flotation sleeve having a buoyancy sufficient to render the entire apparatus positively buoyant in water.

18. An apparatus for mooring a boat to another boat or support structure, comprising:

a) a strut having a first end and a second end, the strut being a hollow tube having a mount socketed thereto at the first end, the mount including a first head axis pin;

b) a first head pivotally coupled to the mount, pivoting about a first head axis that is at an angle relative to the strut, the first head including a rod extending through an aperture through the first head, the rod rotatable within the aperture;

c) a first suction cup rotatably coupled to the first head by a rotating mount rotating about a first cup axis that is at an angle relative to both the strut and the first head axis;

d) a T-shaped second head fixedly coupled to the second end of the strut, the second head including a rod extending through an aperture through the first head, the rod rotatable within the aperture;

e) a second suction cup rotatably coupled to the second head by a rotating mount rotating about a second cup axis that is at an angle relative to the strut; and f) a flotation sleeve coupled about the strut, the flotation sleeve having a buoyancy sufficient to render the entire apparatus positively buoyant in water.

* * * * *